US010410785B2

(12) United States Patent
Hwang

(10) Patent No.: US 10,410,785 B2
(45) Date of Patent: Sep. 10, 2019

(54) CAST RESIN TRANSFORMER

(71) Applicant: LSIS CO., LTD., Gyeonggi-do (KR)

(72) Inventor: Seung-Wook Hwang, Gyeonggi-do (KR)

(73) Assignee: LSIS CO., LTD., Anyang-si, Gyeonggi-do (KR)

( * ) Notice: Subject to any disclaimer, the term of this patent is extended or adjusted under 35 U.S.C. 154(b) by 107 days.

(21) Appl. No.: 15/782,057

(22) Filed: Oct. 12, 2017

(65) Prior Publication Data

US 2018/0114632 A1 Apr. 26, 2018

(30) Foreign Application Priority Data

Oct. 20, 2016 (KR) ..... 10-2016-0136369

(51) Int. Cl.

*H01F 27/06* (2006.01)
*H01F 27/32* (2006.01)
*H01F 27/30* (2006.01)

(52) U.S. Cl.

CPC ..... *H01F 27/327* (2013.01); *H01F 27/06* (2013.01); *H01F 27/306* (2013.01); *H01F 2027/328* (2013.01)

(58) Field of Classification Search

CPC ..... H01F 27/00–36
USPC ..... 336/65, 90, 92, 96, 180–184, 210–215, 336/220–223, 233–234
See application file for complete search history.

(56) References Cited

U.S. PATENT DOCUMENTS

2012/0068800 A1 3/2012 Luckey et al.
2014/0191104 A1 7/2014 Meisel et al.

FOREIGN PATENT DOCUMENTS

| | | | | | |
|---|---|---|---|---|---|
| CN | 204946686 | U | | 1/2016 | |
| CN | 105297903 | A | | 2/2016 | |
| CN | 105405617 | A | | 3/2016 | |
| CN | 105590730 | A | | 5/2016 | |
| JP | S5681910 | A | | 7/1981 | |
| JP | 2000252138 | A | * | 9/2000 | ..... A63H 33/08 |
| JP | 2015-177085 | A | | 10/2015 | |
| KR | 10-1464989 | B1 | | 11/2014 | |
| KR | 101464989 | B1 | | 11/2014 | |

(Continued)

OTHER PUBLICATIONS

Chinese Office Action for related Chinese Application No. 201710966499.5; action dated Dec. 3, 2018; (6 pages).

(Continued)

*Primary Examiner* — Tuyen T Nguyen
(74) *Attorney, Agent, or Firm* — K&L Gates LLP

(57) ABSTRACT

A cast resin transformer having a seismic structure includes: a bed frame seated on a floor, a lower frame coupled to the top of the bed frame, at least one coil installed on the top of the lower frame, an upper frame 50 installed on the top of the coil and located in parallel with the lower frame, a core connected to the coil, a spacer interposed between the coil and the upper frame or the lower frame, a protrusion part which protrudes from the top of the lower frame and is inserted in a groove formed in the lower end of the spacer so as to prevent the spacer interposed between the lower frame and the coil from being detached, and a reinforcement part connected between the bed frame and the lower frame so as to provide a reinforcing function against an external force.

8 Claims, 12 Drawing Sheets

(56) References Cited

FOREIGN PATENT DOCUMENTS

| | | | |
|---|---|---|---|
| KR | 20-2015-0003528 | U | 9/2015 |
| KR | 20-0480888 | Y1 | 7/2016 |
| KR | 10-1659278 | B1 | 9/2016 |
| WO | 2016017381 | A1 | 4/2016 |

OTHER PUBLICATIONS

European Search Report for related European Application No. 17194076.0; report dated Apr. 9, 2018; (7 pages).
Japanese Notice of Allowance for related Japanese Application No. 2017-198711; action dated Oct. 2, 2018; (3 pages).

* cited by examiner (PRIOR ART)

(PRIOR ART)

(PRIOR ART)

(PRIOR ART)

CAST RESIN TRANSFORMER

CROSS-REFERENCE TO RELATED APPLICATIONS

This application claims the priority of Korean Patent Application No. 10-2016-0136369 filed on Oct. 20, 2016, in the Korean Intellectual Property Office, the disclosure of which is hereby incorporated by reference in its entirety.

BACKGROUND

1. Technical Field

The present disclosure relates to a cast resin transformer and more particularly, to a cast resin transformer having a seismic structure.

2. Description of the Related Art

As is well known in the art, a high voltage transformer for electric power is constituted in a power system and plays an important role of stepping up/down a voltage received from a power plant and transmitting electric power to customers.

Such a transformer has to be rigidly mounted, fixed and maintained so that it is not shaken by external factors for stable operation. For example, as the number of recent earthquakes has been increasing, there is a growing interest in designs and structures in preparation for earthquakes (hereinafter referred to as "seismic structures").

A cast resin transformer, which is one type of dry type transformer with windings electrically isolated from the outside by curing (or covering) them with a resin (for example, epoxy or the like), converts a specific voltage to a voltage desired by a user.

FIGS. 1 to 4 are a perspective view, a front view, a plan view and a side view of a conventional typical cast resin transformer, respectively. Referring to FIGS. 1 to 4, the cast resin transformer 1 illustrated is a three-phase cast resin transformer having a plurality of (three in these figures) coils 20 longitudinally arranged in a row along a core 10.

The cast resin transformer 1 includes the core 10, the coils 20, a bed frame 30, a lower frame 40, an upper frame 50 and spacers 60 and 60' interposed between the upper frame 50 and the lower frame 40.

The bed frame 30 of the cast resin transformer 1 is placed on a floor. The lower frame 40 is vertically seated on the bed frame 30 and is coupled to the bottom of the coils 20 so as to support the coils 20, with the spacer 60 interposed therebetween. The upper frame 50 is coupled to the top of the coils 20, with the spacer 60' therebetween, as opposed to the lower frame 40. A connecting plate 70 is provided between the lower frame 40 and the upper frame 50.

Such a structure of the conventional cast resin transformer 1 may allow the spacer 60 constrained between the lower frame 40 and the coils 20 to be securely positioned when no seismic force exerts on the cast resin transformer 1.

However, if an earthquake or a similar external impact exerts on the cast resin transformer 1, there is a possibility that the spacer 60 may have a clearance or even fall off between the lower frame 40 and the coils 20. This may result in serious damage to the cast resin transformer 1.

As an example, if a strong seismic force exerts on the cast resin transformer 1, the cast resin transformer 1 largely undergoes a displacement in a direction (denoted by W1 in FIG. 4) and forces in directions (denoted by F1 and F2 in FIG. 4). If the coils 20 are severely damaged due to vibration and displacement by their own weights, the spacer 60 constrained between the coils 20 and the lower frame 40 may be horizontally moved (or slipped) to fall off between the lower frame 40 and the coils 20.

Accordingly, there is a need of technique for reducing the displacement of the cast resin transformer 1 on which a seismic force (or a similar external force) exerts, thereby preventing falling-off or detachment of the spacer 60 and suppressing the elastic and plastic deformation of a steel structure (e.g., the lower frame, the upper frame, etc.).

As the related prior art, Korean Utility Model Publication No. 20-2012-0003664 discloses a cast resin transformer.

SUMMARY

It is an aspect of the present disclosure to provide a cast resin transformer having a seismic structure.

It is another aspect of the present disclosure to provide a cast resin transformer capable of reducing a displacement occurring in the cast resin transformer when a seismic force (or similar external force) exerts on the cast resin transformer, thereby preventing a spacer from being detached.

It is another aspect of the present disclosure to provide a cast resin transformer capable of suppressing elastic and plastic deformation of a steel structure (e.g., a lower frame, an upper frame, a bed frame, etc.) so as to reduce a displacement occurring in the cast resin transformer when a seismic force exerts on the cast resin transformer.

It should be noted that objects of the present disclosure are not limited to the above-described objects, and other objects of the present disclosure will be apparent to those skilled in the art from the following descriptions.

In accordance with one aspect of the present disclosure, there is provided a cast resin transformer including: a bed frame seated on a floor; a lower frame coupled to the top of the bed frame; at least one coil installed on the top of the lower frame; an upper frame installed on the top of the coil and located in parallel with the lower frame; a core connected to the coil; a spacer interposed between the coil and the upper frame or the lower frame; a protrusion part which protrudes from the top of the lower frame and is inserted in a groove formed in the lower end of the spacer so as to prevent the spacer interposed between the lower frame and the coil from being detached; and a reinforcement part connected between the bed frame and the lower frame so as to provide a reinforcing function against an external force.

In some embodiment, the groove may have a size larger than the width of the protrusion part and the spacer is formed so as to move within a clearance space in a state where the protrusion part is inserted in the groove.

The protrusion part may include a fastening screw penetrating through the lower frame; and a fixing nut coupling the fastening screw to the lower frame.

The protrusion part may be welded to protrude by a predetermined height from the top of the lower frame.

The reinforcement part may be connected in parallel to the bed frame in a direction crossing the lower frame.

The reinforcement part may include a reinforcing frame protruding from the top of the bed frame and supporting the side surface of the lower frame; and a connecting frame connected through the lower end of the reinforcing frame and closely fixed to the top surface of the bed frame.

The reinforcing frame and the lower frame may be coupled to each other by welding or a fixing bolt and the connecting frame and the bed frame may be coupled to each other by welding or a fixing bolt.

The cast resin transformer may further include a gusset part which supports at least one of the top and bottom of the lower frame so as to suppress deformation of the lower frame due to movement of the at least one coil and the spacer.

The gusset part may be provided in the lower side of the spacer through the lower frame in correspondence to the position of the spacer.

The gusset part may include a rectangular plate which integrally connects the top and bottom of the lower spacer with an intersection with the side surface of the lower frame.

The gusset part may include a triangular plate which is installed on at least one of the top and bottom of the lower spacer with an intersection with the side surface of the lower frame.

The cast resin transformer of the present disclosure has an advantage of reducing a displacement occurring in the cast resin transformer when a seismic force (or similar external force) exerts on the cast resin transformer, thereby preventing a spacer from being detached. Accordingly, it is possible to prevent damage and failure of the whole cast resin transformer which may occur due to the detachment of the spacer.

The cast resin transformer of the present disclosure has another advantage of suppressing elastic and plastic deformation of a steel structure (e.g., a lower frame, an upper frame, a bed frame, etc.) so as to reduce a displacement occurring in the cast resin transformer when a seismic force (or similar external force) exerts on the cast resin transformer.

In addition to the above-described effects, specific effects of the present disclosure will be described together with embodiments to be described below.

DETAILED DESCRIPTION

Figure 1:
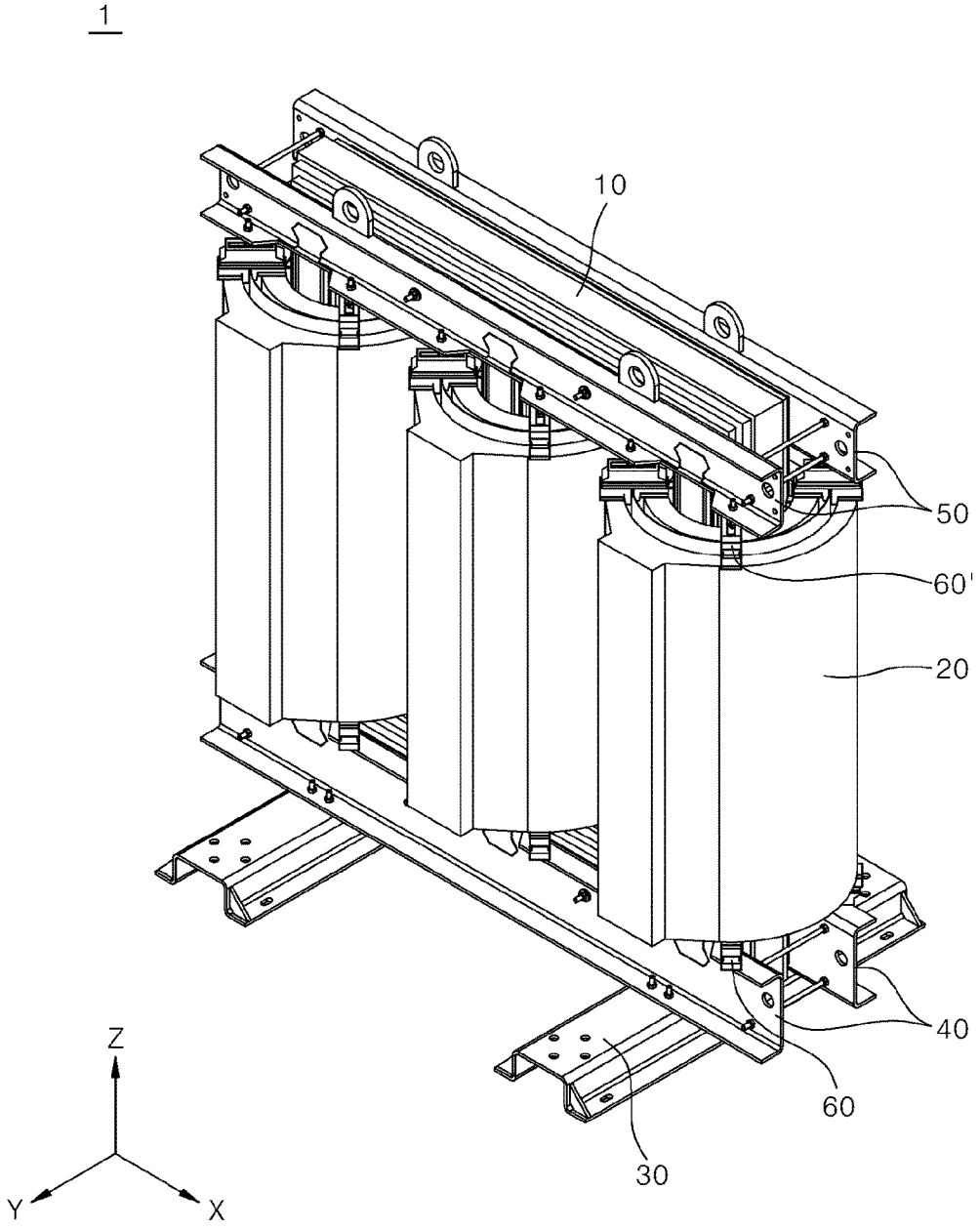
FIG. 1 is a perspective view of a conventional typical cast resin transformer.
Figure 2:
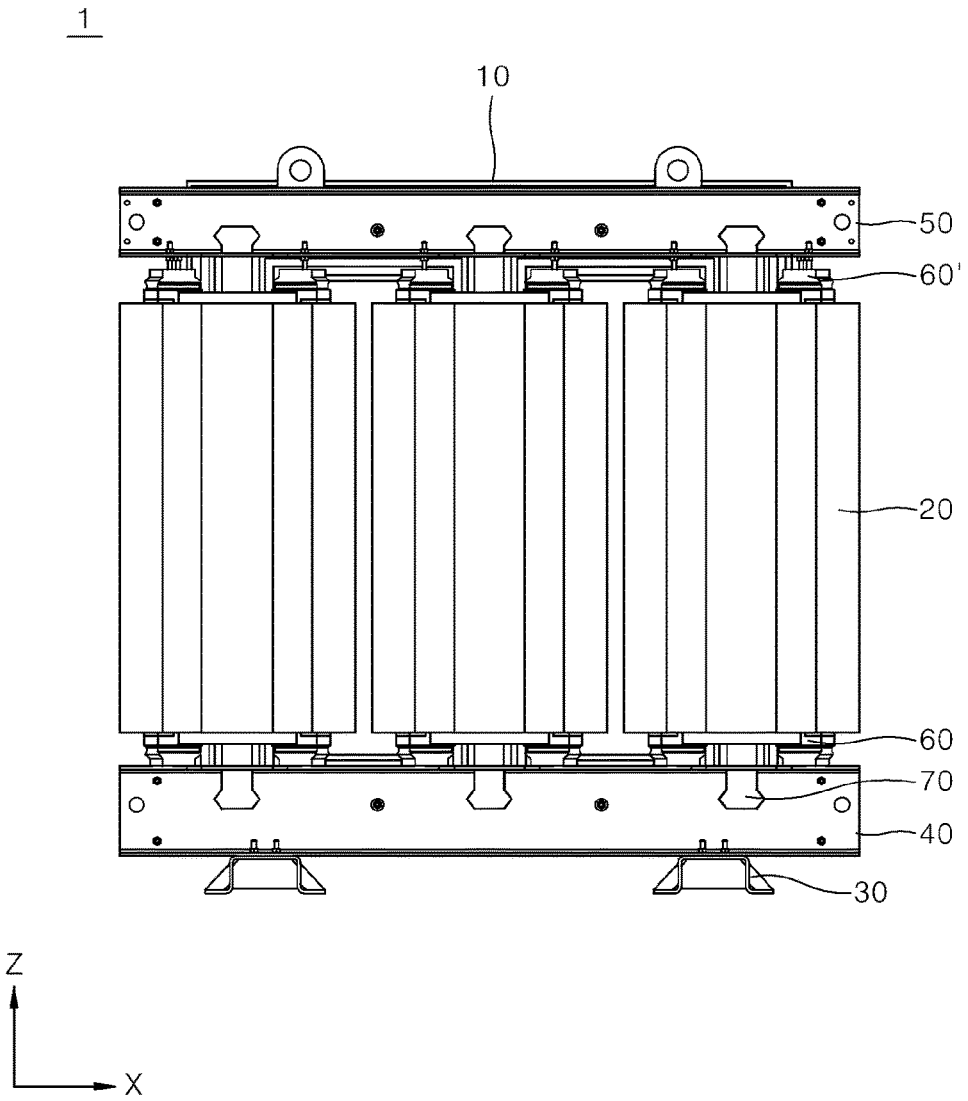
FIG. 2 is a front view of the conventional typical cast resin transformer.
Figure 3:
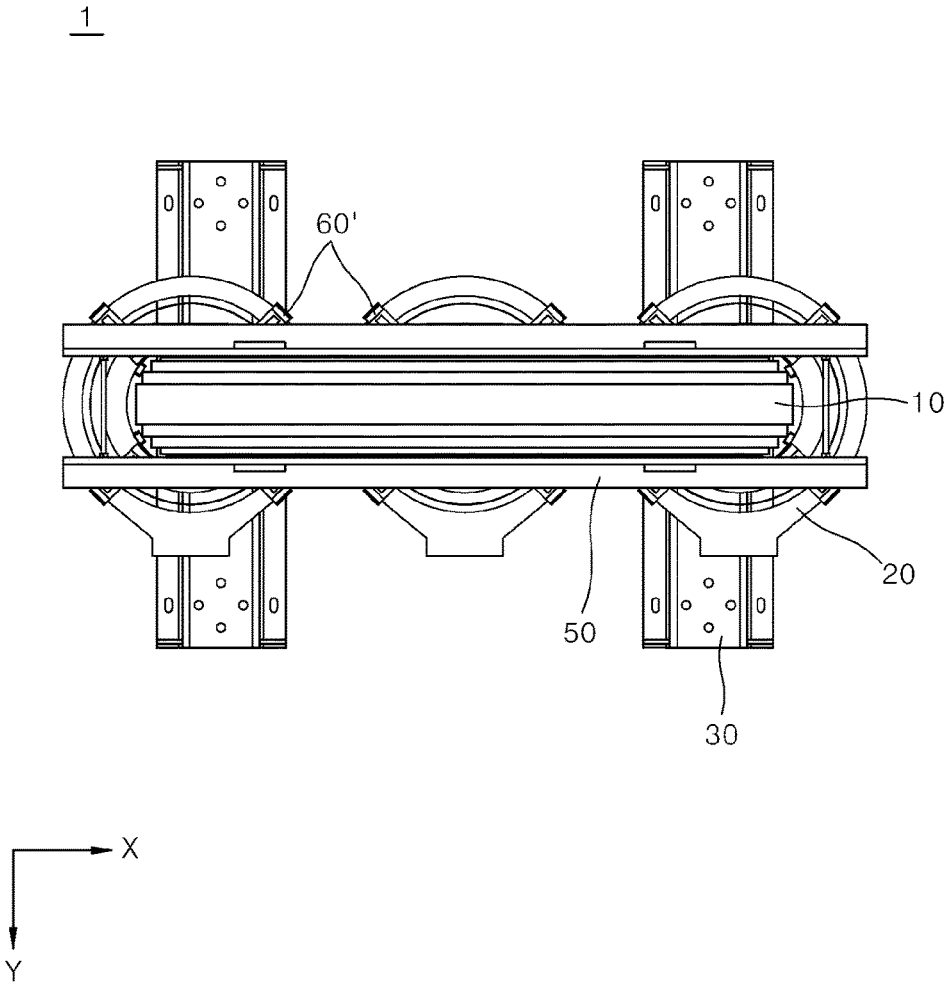
FIG. 3 is a plan view of the conventional typical cast resin transformer.
Figure 4:
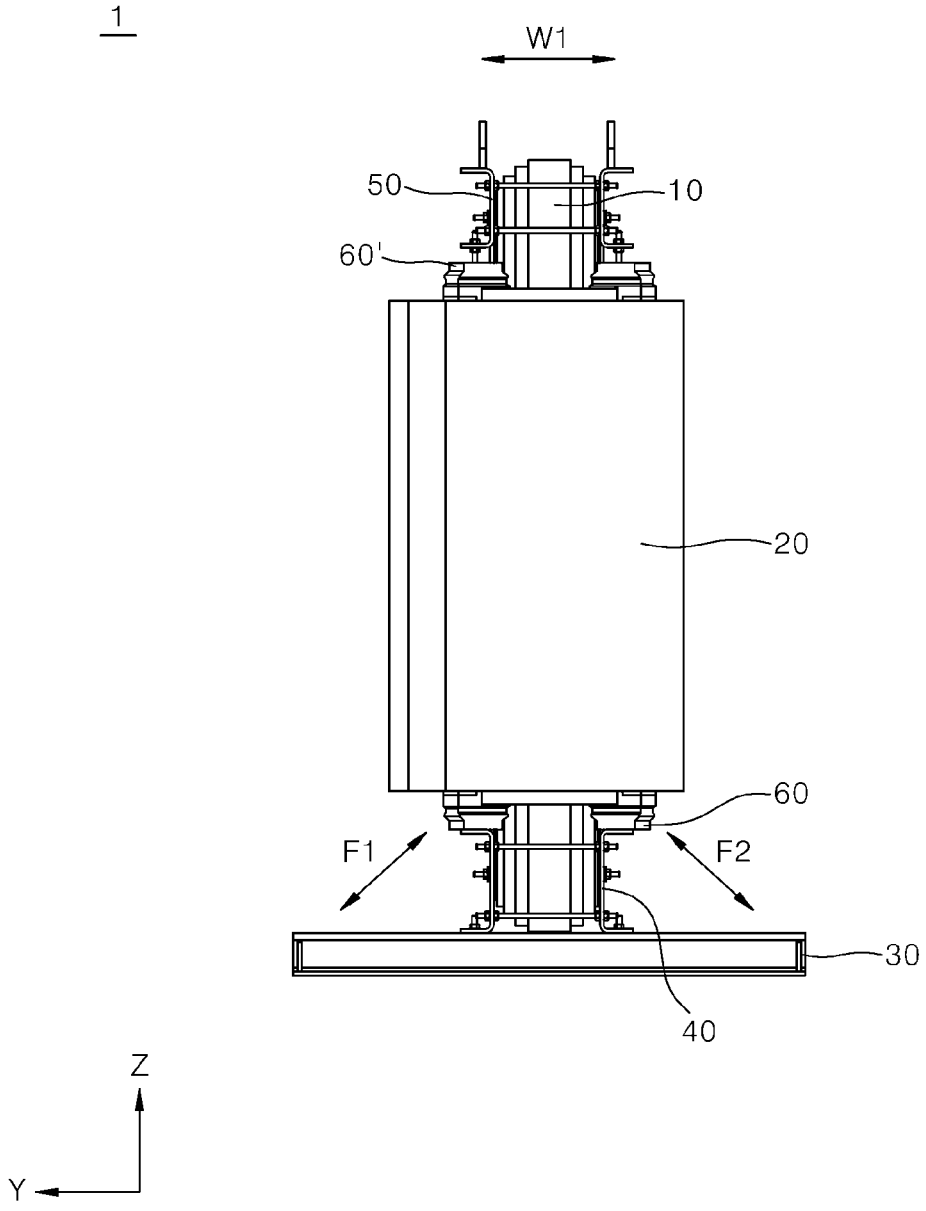
FIG. 4 is a side view of the conventional typical cast resin transformer.

Hereinafter, exemplary embodiments of the present disclosure will be described in detail with reference to the accompanying drawings.

However, the present disclosure is not limited to exemplary embodiments disclosed herein but may be implemented in various different ways. The exemplary embodiments are provided for a thorough and complete understanding of the present disclosure, and for fully conveying the scope of the present disclosure to those skilled in the art. It is to be noted that the scope of the present disclosure is defined only by the claims.

As is well known in the art, a high voltage transformer for electric power is constituted in a power system and plays an important role of stepping up/down a voltage received from a power plant and transmitting electric power to customers. Such a transformer has to be rigidly mounted, fixed and maintained so that it is not shaken by external factors for stable operation. For example, as the number of recent earthquakes has been increasing, there is a growing interest in designs and structures in preparation for earthquakes (hereinafter referred to as "seismic structures"). A cast resin transformer, which is one type of dry type transformer with windings electrically isolated from the outside by curing (or covering) them with a resin (for example, epoxy or the like), converts a specific voltage to a voltage desired by a user.

FIGS. 5 to 8 are a perspective view, a front view, a plan view and a side view of a cast resin transformer according to an exemplary embodiment, respectively. FIGS. 9 to 12 illustrate various examples of change in shape of a gusset part in the cast resin transformer.

Referring to FIGS. 5 to 8, the cast resin transformer 100 according to the exemplary embodiment of the present disclosure includes a core 10, a plurality of coils 20, a bed frame 30, a lower frame 40, an upper frame 50 and spacers 60 and 60'. The cast resin transformer 100 further includes a protrusion part 110, a reinforcement part 130 and a gusset part 150 for a seismic structure.

As illustrated here, the cast resin transformer 100 may be a three-phase cast resin transformer having a structure including the core 10 and three coils 20 longitudinally arranged in a row along the core 10. It is to be, however, noted that the number of coils 30 is not limited to three but may be smaller or larger although not separately shown.

The bed frame 30 may be one pair of two members arranged side by side at a predetermined distance and seated on a floor on which the coils 20 is installed, that is, the floor of a place on which the cast resin transformer 100 is installed. It is to be, however, noted that the number of bed frames 30 is not limited to two but may be three or more.

The lower frame 40 is coupled to the top of the bed frame 30 so as to support the coils 20.

Specifically, the lower frame 40 may be a member having a 'C'-shaped section. The top 41 of the lower frame 40 protrudes outwardly and the bottom of the lower frame 40 protrudes outwardly in the same or similar way as the top 41.

The upper frame 50 is vertically located in parallel to the lower frame 40 with a distance therebetween to so as to support the top of the coils 20. The upper frame 50 may have the same sectional shape as the lower frame 40 but may have different sectional shapes.

A connecting plate 70 is provided between the lower frame 40 and the upper frame 50.

The spacer 60 is interposed between the lower frame 40 and the coils 20 and the spacer 60' is interposed between the upper frame 50 and the coils 20.

Specifically, the lower frame 40 is disposed on the top of the bed frame 30 in an intersecting direction thereof and is coupled to support the coils 20 through the spacer 60.

When an external force such as a seismic force does not exert on the cast resin transformer 100 constructed as above, the spacer 60 can be positioned between the lower frame 40 and the coils 20.

However, if a seismic force by an earthquake exerts on the cast resin transformer 1, there is a possibility that the spacer 60 interposed between the lower frame 40 and the coils 20 may be moved or be deviated from its initial position. This may result in serious damage or failure to the whole cast resin transformer 1.

Figure 8:
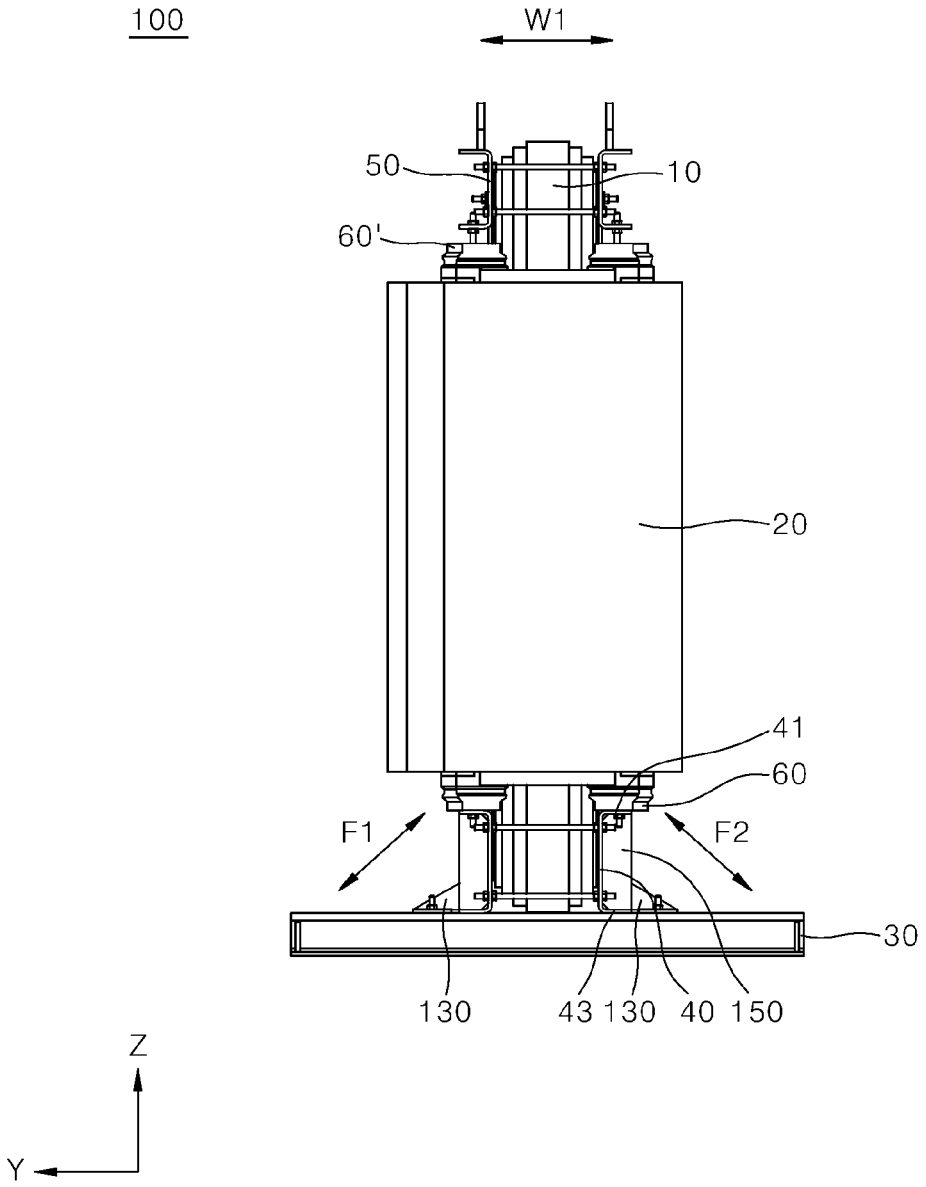
FIG. 8 is a side view of the cast resin transformer according to the exemplary embodiment of the present disclosure.

As an example, if a seismic force exerts on the cast resin transformer 1, the cast resin transformer 1 undergoes a displacement in a direction (denoted by W1 in FIG. 8) and forces in directions (denoted by F1 and F2 in FIG. 8). When the coils 20 are vibrated and displayed by their own weights, the spacer 60 interposed between the coils 20 and the lower frame 40 may be horizontally moved, which may result in detachment of the spacer 60 and deformation of the lower frame 40.

As described above, the cast resin transformer 100 according to the exemplary embodiment of the present disclosure includes the protrusion part 110, the reinforcement part 130 and the gusset part 150 so as to exhibit a seismic function to protect the cast resin transformer 100 against an external impact such as a seismic force.

The protrusion part 110 is a member interposed between the lower frame 40 and the coil 20 to prevent the spacer 60 supporting the coils 20 from falling off or being detached.

To this end, the protrusion part 110 may be formed to protrude by a predetermined height from the top of the lower frame 30. The protrusion part 110 is inserted in a groove 61 (see an enlarged section of FIG. 5) formed in the lower end of the spacer 60.

Therefore, it is preferable that the protrusion height of the protrusion part 110 is slightly lower than the depth of the groove 61.

Figure 5:
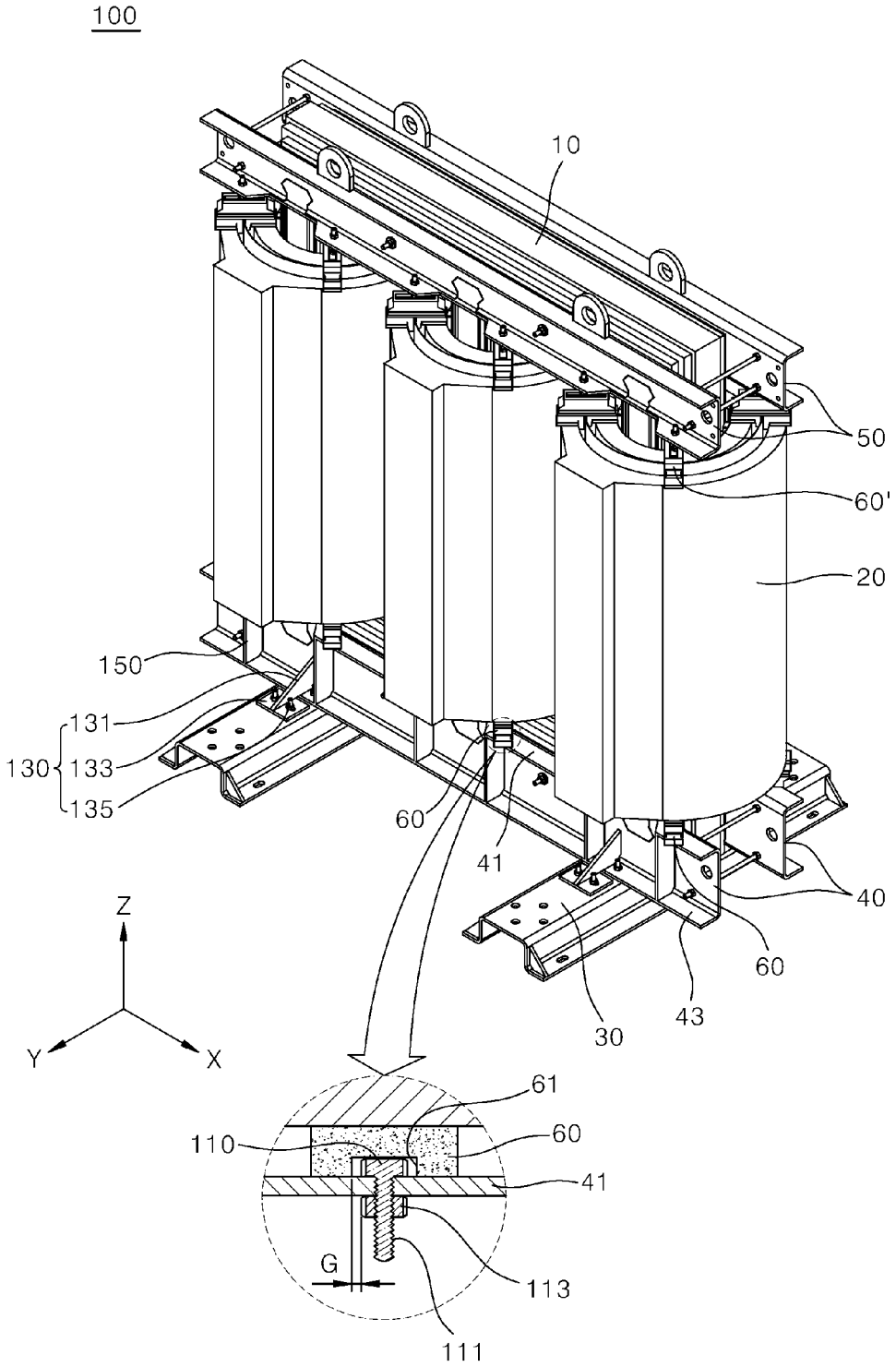
FIG. 5 is a perspective view of a cast resin transformer according to an exemplary embodiment of the present disclosure.
Figure 6:
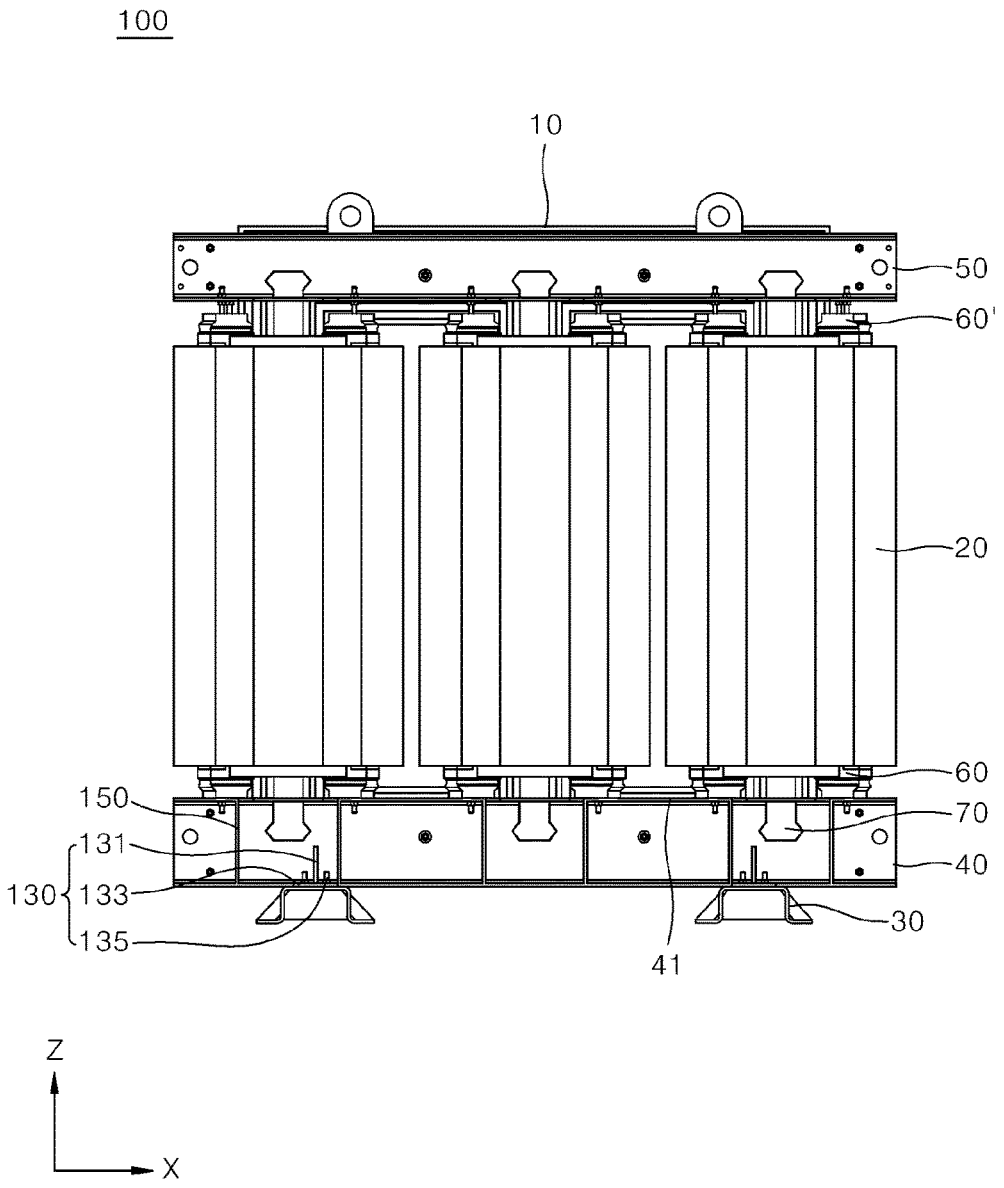
FIG. 6 is a front view of the cast resin transformer according to the exemplary embodiment of the present disclosure.
Figure 7:
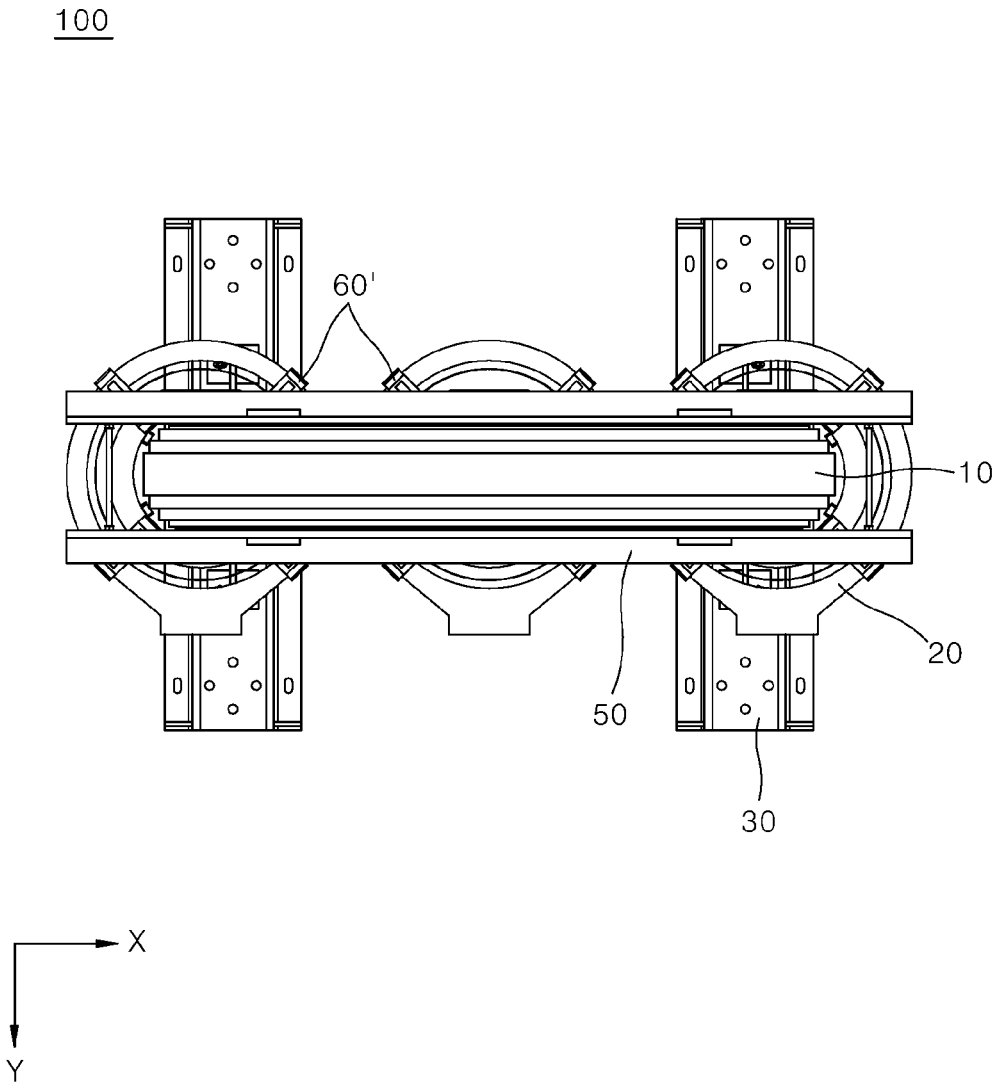
FIG. 7 is a plan view of the cast resin transformer according to the exemplary embodiment of the present disclosure.

More specifically, referring to the enlarged section of FIG. 5, the groove 61 may have a size larger than the width of the protrusion part 110.

This allows the spacer 60 to move horizontally within a clearance space G in a state where the protruding part 110 is inserted in the groove 61. Such a clearance space in the protrusion part 110 can absorb an impact.

Accordingly, even when an external force such as a seismic force exerts on the cast resin transformer 100 to make a vibration and displacement due to the self-weight of the coils 20, the spacer 60 can move within an allowable range without being detached.

For example, the protrusion part 110 may be provided in the form of a bolt, or more specifically, a head of a bolt. In this case, a fastening screw 111 penetrating through the top 41 of the lower frame 40 may be installed in the bottom of the protrusion part 110. In addition, a fixing nut 113 coupling the fastening screw 111 to the top 41 of the lower frame 40 may be provided.

As another example, although not shown, the protrusion part 110 may be welded to the top 41 of the lower frame 40 in a protruding manner. In this case, the fastening screw 111 and the fixing nut 113 may not be provided.

The reinforcement part 130 can be connected between the bed frame 30 and the lower frame 40 in the direction against a seismic force (i.e., in the direction against the forces F1 and F2 shown in FIG. 8).

Specifically, the reinforcement part 130 may be connected in parallel to the bed frame 30 in a direction crossing the lower frame 40.

For example, the reinforcement part 130 includes a reinforcing frame 131 and a connecting frame 133.

The reinforcing frame 131 protrudes from the top of the bed frame 30 and may have a triangular plate shape to support the side surface of the lower frame 40.

The connecting frame 133 is connected through the lower end of the reinforcing frame 131. The connecting frame 133 can be closely fixed to face the top surface of the bed frame 30.

At this time, preferably, the reinforcing frame 131 and the lower frame 40 have structural stability when they are joined by welding. On the other hand, the connecting frame 133 may be fastened to the top of the bed frame 30 by a plurality of fixing bolts 135.

However, the reinforcement part 130 is not necessarily limited to such a structural coupling relation but may be coupled in different forms.

The reinforcement part 130 thus configured has an effect of dispersing the forces F1 and F2 shown in FIG. 8 to suppress a displacement that may occur in the W1 direction. Thereby, it is possible to suppress the momentum of the coils 20 and ensure structural stability against a seismic force.

The gusset part 150 is used to suppress deformation of the lower frame 40 due to movement of the coils 20 and the spacer 60. To this end, the gusset part 150 is configured to support at least one of the top 41 and bottom 43 of the lower frame 40.

Preferably, the gusset part 150 may be provided on the lower side of the spacer 60 through the lower frame 40 in correspondence to the position of the spacer 60.

Referring to FIG. 5, the gusset part 150 is formed in the form of a rectangular plate that integrally connects the top 41 and bottom 43 of the lower frame 40 with an intersection with the side surface of the lower frame 40.

At this time, the gusset part 150 may be provided one by one on the lower side of the spacer 60 in correspondence to the position of the spacer 60. Thus, the gusset part 150 can suppress the elastic and plastic deformation of the lower frame 40, which may occur due to the movement of the coils 20 and the spacer 60.

The cast resin transformer according to the exemplary embodiment of the present disclosure may have various modifications depending on the shape of the gusset part 150, as will be described with reference to FIGS. 9 to 12.

Figure 9:
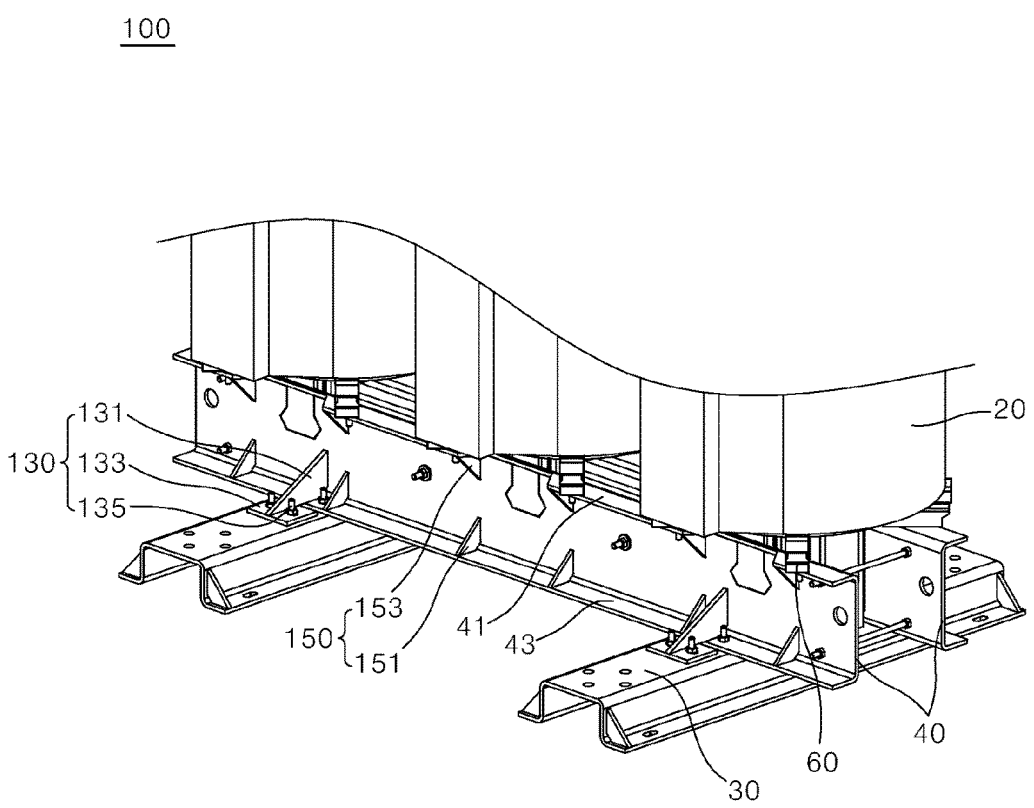
FIG. 9 is a partial perspective view of a first modification of a gusset part in the cast resin transformer according to the exemplary embodiment of the present disclosure.

FIG. 9 is a partial perspective view of a first modification of the gusset part 150 in the cast resin transformer according to the exemplary embodiment of the present disclosure.

Referring to FIG. 9, the gusset part 150 includes two triangular plates individually mounted on the top 41 and bottom 43 of the lower frame 40 with an intersection with the side surface of the lower frame 40.

Specifically, the gusset part 150 may include a first triangular plate 151 mounted on the bottom 43 of the lower frame 40 and a second triangular plate 151 interposed between the top 41 of the lower frame 40 and the side surface of the lower frame 40. Thus, the gusset part 150 can suppress the elastic and plastic deformation of the lower frame 40, which may occur due to the movement of the coils 20 and the spacer 60.

Figure 10:
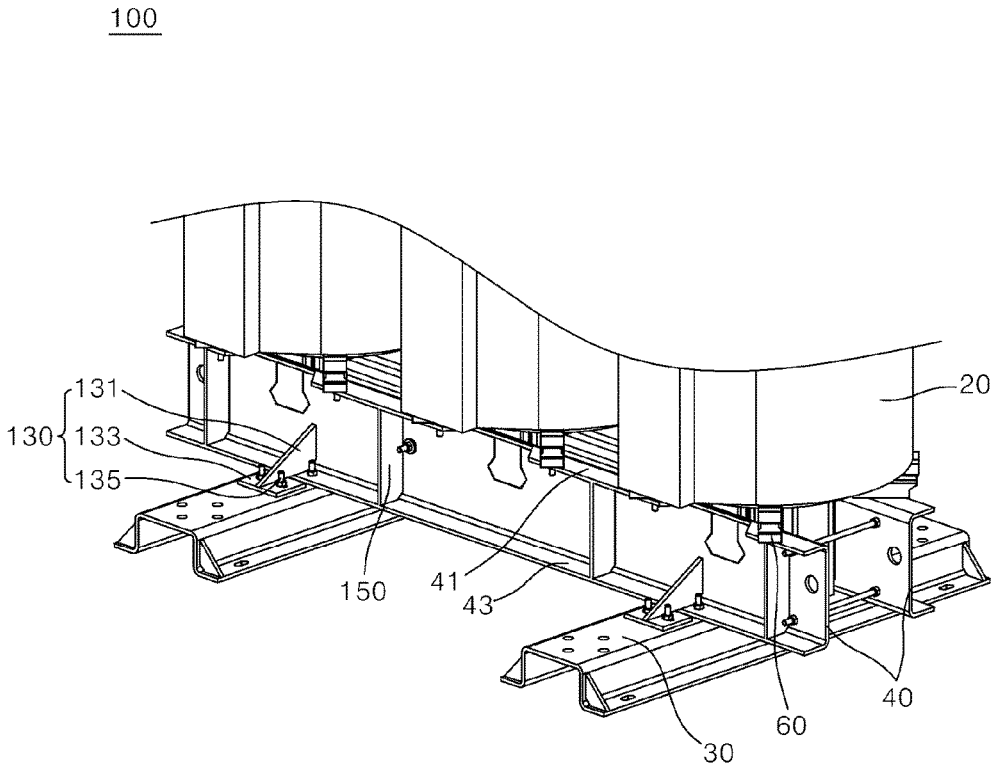
FIG. 10 is a partial perspective view of a second modification of the gusset part in the cast resin transformer according to the exemplary embodiment of the present disclosure.

FIG. 10 is a partial perspective view of a second modification of the gusset part 150 in the cast resin transformer according to the exemplary embodiment of the present disclosure.

Referring to FIG. 10, the gusset part 150 includes a rectangular plate that integrally connects the top 41 and bottom 43 of the lower frame 40 with an intersection with the side surface of the lower frame 40, as shown in FIG. 5.

However, the gusset part 150 shown in FIG. 10 is not necessarily provided one by one on the lower side of the spacer 60 in correspondence to the position of the spacer 60 but the number of gusset parts 150 may be smaller than the number of spacers 60, although not limited to the number shown. The number of gusset parts 150 may be appropriately adjusted and may be increased or decreased as needed.

Figure 11:
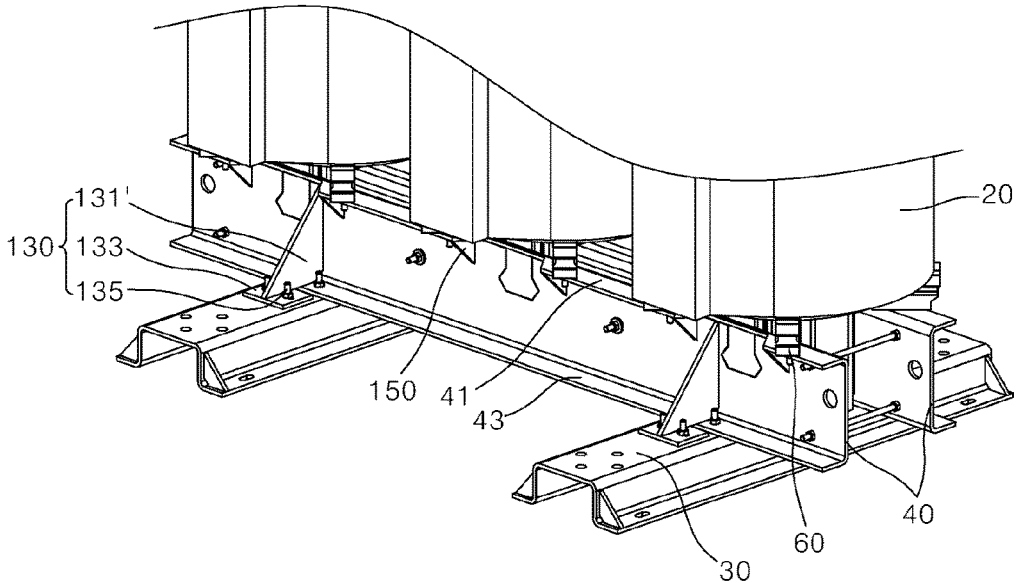
FIG. 11 is a partial perspective view of a third modification of the gusset part in the cast resin transformer according to the exemplary embodiment of the present disclosure.

FIG. 11 is a partial perspective view of a third modification of the gusset part 150 in the cast resin transformer according to the exemplary embodiment of the present disclosure.

Referring to FIG. 11, the gusset part 150 may be installed in the form of a triangular plate on the top 41 of the lower frame 40 with an intersection with the side surface of the lower frame 40.

In this case, the structure of the reinforcement part 130 can be improved to increase the structural stability. More specifically, a reinforcing frame 131' having a larger size may be applied to improve the support effect of the lower frame 40 through the reinforcement part 130.

Figure 12:
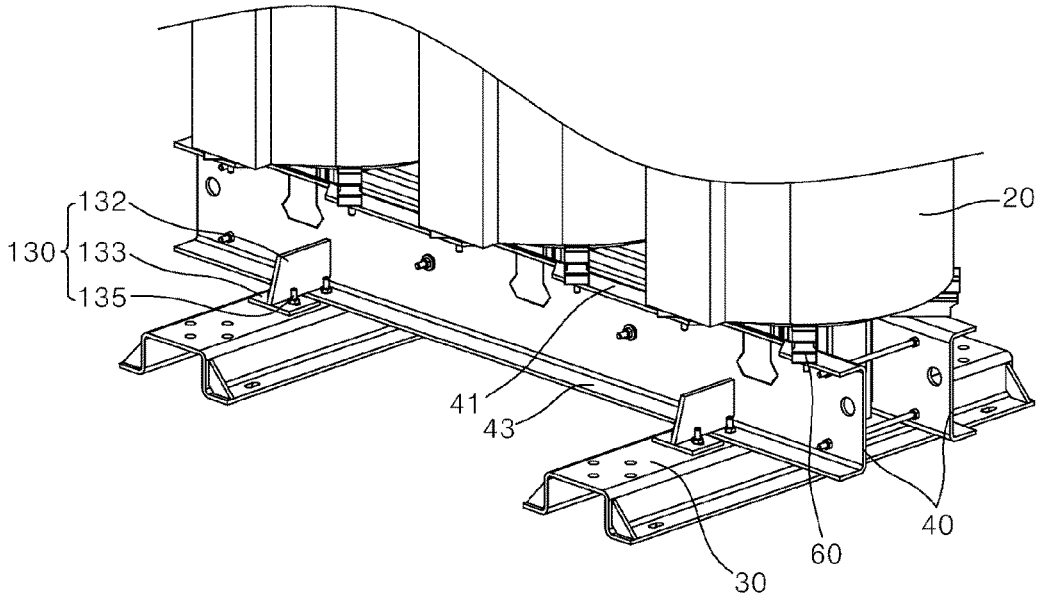
FIG. 12 is a partial perspective view of a modification in which the gusset part is excluded from the cast resin transformer according to the exemplary embodiment of the present disclosure and the shape of a reinforcement part is changed.

FIG. 12 is a partial perspective view of a modification in which the gusset part 150 is excluded from the cast resin transformer according to the exemplary embodiment of the present disclosure and the shape of the reinforcement part 130 is changed.

Referring to FIG. 12, the gusset part 150 described in the above exemplary embodiment is excluded from the cast resin transformer and the configuration of the reinforcement unit 130 is changed accordingly.

Specifically, instead of the triangular reinforcing frame 131 (see FIG. 5) described in the above exemplary embodiment, a trapezoidal reinforcing frame 132 is used in the reinforcement part 130 shown in FIG. 12. In this way, the gusset part may be omitted if necessary, and the shape of the reinforcement portion may be changed in different ways.

As described above, the cast resin transformer of the present disclosure has an advantage of reducing a displacement occurring in the cast resin transformer when a seismic force (or similar external force) exerts on the cast resin transformer, thereby preventing a spacer from being detached. Accordingly, it is possible to prevent damage and failure of the whole cast resin transformer which may occur due to the detachment of the spacer.

The cast resin transformer of the present disclosure has another advantage of suppressing elastic and plastic deformation of a steel structure (e.g., a lower frame, an upper frame, a bed frame, etc.) so as to reduce a displacement occurring in the cast resin transformer when a seismic force (or similar external force) exerts on the cast resin transformer.

While the present disclosure has been described with reference to the exemplary embodiments and the drawings, it is to be understood that the scope of the present disclosure is not limited to the disclosed exemplary embodiments. It will be understood that various modifications may be made by those skilled in the art. In addition, predictable effects that can be achieved by the configurations of the present disclosure are obvious to those skilled in the art, whether or not explicitly described with respect to the exemplary embodiment of the present disclosure.

What is claimed is:

1. A cast resin transformer, comprising:

a bed frame seated on a floor;

a lower frame coupled to the top of the bed frame;

at least one coil installed on the top of the lower frame;

an upper frame installed on the top of the coil and located in parallel with the lower frame;

a core connected to the coil;

a spacer interposed between the coil and the upper frame or the lower frame;

a protrusion part which protrudes from the top of the lower frame and is inserted in a groove formed in the lower end of the spacer so as to prevent the spacer interposed between the lower frame and the coil from being detached;

a reinforcement part connected between the bed frame and the lower frame so as to provide a reinforcing function against an external force; and a gusset part which supports at least one of the top and bottom of the lower frame so as to suppress deformation of the lower frame due to movement of the at least one coil and the spacer, wherein the groove has a size larger than the width of the protrusion part, wherein a protrusion height of the protrusion part is lower than the depth of the groove, and wherein the spacer is formed so as to move within a clearance space in a state where the protrusion part is inserted in the groove, and wherein the gusset part is provided in the lower side of the spacer through the lower frame in correspondence to the position of the spacer.

2. The cast resin transformer according to claim 1, wherein the protrusion part includes:

a fastening screw penetrating through the lower frame; and a fixing nut coupling the fastening screw to the lower frame.

3. The cast resin transformer according to claim 1, wherein the protrusion part is welded to protrude by a predetermined height from the top of the lower frame.

4. The cast resin transformer according to claim 1, wherein the reinforcement part is connected in parallel to the bed frame in a direction crossing the lower frame.

5. The cast resin transformer according to claim 1, wherein the reinforcement part includes:

a reinforcing frame protruding from the top of the bed frame and supporting the side surface of the lower frame; and a connecting frame connected through the lower end of the reinforcing frame and closely fixed to the top surface of the bed frame.

6. The cast resin transformer according to claim 5, wherein the reinforcing frame and the lower frame are coupled to each other by welding or a fixing bolt and the connecting frame and the bed frame are coupled to each other by welding or a fixing bolt.

7. A cast resin transformer, comprising:

a bed frame seated on a floor;

a lower frame coupled to the top of the bed frame;

at least one coil installed on the top of the lower frame;

an upper frame installed on the top of the coil and located in parallel with the lower frame;

a core connected to the coil;

a spacer interposed between the coil and the upper frame or the lower frame;

a protrusion part which protrudes from the top of the lower frame and is inserted in a groove formed in the lower end of the spacer so as to prevent the spacer interposed between the lower frame and the coil from being detached;

a reinforcement part connected between the bed frame and the lower frame so as to provide a reinforcing function against an external force; and a gusset part which supports at least one of the top and bottom of the lower frame so as to suppress deformation of the lower frame due to movement of the at least one coil and the spacer, wherein the groove has a size larger than the width of the protrusion part, wherein a protrusion height of the protrusion part is lower than the depth of the groove, and wherein the spacer is formed so as to move within a clearance space in a state where the protrusion part is inserted in the groove, and wherein the gusset part includes a rectangular plate which integrally connects the top and bottom of the lower frame with an intersection with the side surface of the lower frame.

8. A cast resin transformer, comprising:

a bed frame seated on a floor;

a lower frame coupled to the top of the bed frame;

at least one coil installed on the top of the lower frame;

an upper frame installed on the top of the coil and located in parallel with the lower frame;

a core connected to the coil;

a spacer interposed between the coil and the upper frame or the lower frame;

a protrusion part which protrudes from the top of the lower frame and is inserted in a groove formed in the lower end of the spacer so as to prevent the spacer interposed between the lower frame and the coil from being detached;

a reinforcement part connected between the bed frame and the lower frame so as to provide a reinforcing function against an external force; and a gusset part which supports at least one of the top and bottom of the lower frame so as to suppress deformation of the lower frame due to movement of the at least one coil and the spacer, wherein the groove has a size larger than the width of the protrusion part, wherein a protrusion height of the protrusion part is lower than the depth of the groove, wherein the spacer is formed so as to move within a clearance space in a state where the protrusion part is inserted in the groove, and wherein the gusset part includes a triangular plate which is installed on at least one of the top and bottom of the lower frame with an intersection with the side surface of the lower frame.

* * * * *